US007833323B2

(12) United States Patent
Takayanagi et al.

(10) Patent No.: US 7,833,323 B2
(45) Date of Patent: Nov. 16, 2010

(54) FLOTAGE TRAPPING DEVICE USING ELECTROSTATIC FIELD

(75) Inventors: Makoto Takayanagi, Shizuoka (JP); Akitoshi Takagi, Shizuoka (JP); Yasunori Imagawa, Shizuoka (JP)

(73) Assignee: Trinc.org

( * ) Notice: Subject to any disclaimer, the term of this patent is extended or adjusted under 35 U.S.C. 154(b) by 261 days.

(21) Appl. No.: 12/050,013

(22) Filed: Mar. 17, 2008

(65) Prior Publication Data

US 2008/0250929 A1 Oct. 16, 2008

(30) Foreign Application Priority Data

Apr. 13, 2007 (JP) ..... 2007-105451

(51) Int. Cl.
*B03C 3/68* (2006.01)
*B03C 3/86* (2006.01)

(52) U.S. Cl. ..... 96/24; 96/26; 96/83; 96/84; 96/86; 96/94; 96/96

(58) Field of Classification Search ..... 96/23, 96/24, 26, 39–42, 83–86, 89, 91, 94, 96; 95/7, 77; 210/243, 748.01
See application file for complete search history.

(56) References Cited

U.S. PATENT DOCUMENTS 2,866,517 A * 12/1958 Phyl ..... 96/91
3,175,341 A * 3/1965 Winter ..... 96/86
3,849,090 A * 11/1974 Remick ..... 96/86
5,290,343 A * 3/1994 Morita et al. ..... 96/39
5,641,342 A * 6/1997 Smith et al. ..... 96/77
5,669,963 A * 9/1997 Horton et al. ..... 96/77
6,126,727 A * 10/2000 Lo ..... 96/39
7,244,289 B2 * 7/2007 Su ..... 96/39
7,258,715 B2 * 8/2007 Cox et al. ..... 55/422
7,332,019 B2 * 2/2008 Bias et al. ..... 96/15
7,540,903 B2 * 6/2009 Ladrech et al. ..... 96/83
2007/0028775 A1 * 2/2007 Loup et al. ..... 96/83
2008/0028937 A1 * 2/2008 Paterson et al. ..... 96/81

FOREIGN PATENT DOCUMENTS

EP 0030400 A1 * 6/1981 ..... 96/86

* cited by examiner

*Primary Examiner*—Richard L Chiesa
(74) *Attorney, Agent, or Firm*—Leighton K. Chong

(57) ABSTRACT

There is provided a flotage trapping device using electrostatic field. The flotage trapping device has a body including a power source portion and a boosting portion fed from the power source portion, and a collector portion including a collector to which the plus and/or minus high voltage obtained from the boosting portion is applied. The collector portion is formed as a collector cassette by unitizing the collector portion in the form of a cassette. A fixing mechanism is provided between the body and the collector cassette for connecting and disconnecting the body and the collector cassette through one-touch operation. The electric connector for high voltage is provided between the body and the collector cassette for electrically connecting and disconnecting the body and the collector cassette through one-touch operation. As a result the collector cassette is detachably mounted on the body.

11 Claims, 5 Drawing Sheets

FLOTAGE TRAPPING DEVICE USING ELECTROSTATIC FIELD

TECHNICAL FIELD

This invention relates to a flotage trapping device which traps or captures the flotage such as dust or mist using electrostatic field.

BACKGROUND OF INVENTION

As a flotage trapping device which traps or captures the flotage such as dust or mist using electrostatic field, the device in which dust, mist or the like is trapped or captured by applying high voltage to its collector portion, or the device in which an ion generating device is disposed adjacent to the flotage trapping device so that floating dust or mist are forcibly charged in order to enhance efficiency of trapping the flotage on the voltage applied collector portion has been developed.

The flotage trapping device using electrostatic field has merits in that it does not require a blow fan by which wind is forcibly blown to a filter, different from trapping device using a filter, and the effects given to a clean environment can be suppressed to the minimum since dust is not wound up due to calm.

However, although the collector for trapping the flotage such as dust, mist should be periodically maintained, there is a problem in that the flotage trapping device using electrostatic field takes a lot of trouble over maintenance more than a filter-type device.

Furthermore, if the collector portion is made by a rigid plate the collector portion becomes expensive. Particularly, there is a problem in that the more the collector is made to be large in order to enhance capability of trapping the flotage, the more the collector is expensive.

Furthermore, if the collector portion is made by the electric conductors having a flexible property such as electric wire, the material cost of collector portion can be suppressed. However, there are problems in that if the electric conductors are soldered at many places to form a collector portion, soldered portions are at risk for leakage and it is difficult to adjust the tension of wiring to be in uniformity, so the cost for assembling a collector portion become expensive.

Furthermore the flotage trapping device which has a collector portion traps or captures the flotage by applying high voltage to it from power supply of its main body, has more problems such as it can't detect the disconnection of the electric wire in the collector portion, uninstallation of the collector portion, bad connection of the connecter between the collector portion and main body, and in addition if short circuit or leakage to the earth occurs at the portion where the high voltage is applied these can not be detected as well.

Moreover, when a plurality of flotage trapping devices are installed to trap the flotage such as dust or mist or the like in more large area, an outlet for power source should be prepared for each device, and if an AC adapter for use with the outlet is prepared for each flotage trapping device the additional cost of AC adapters is generated.

Additionally, in case that a plurality of flotage trapping devices are installed, these devices are used in a large area. In such a case, in order to detect the occurrence of abnormal state at any device, all devices should be checked. It takes a lot of trouble and there would be oversight.

Therefore, it is an object of the present invention to provide a flotage trapping device using electrostatic field which overcomes the above-mentioned problems.

SUMMARY OF INVENTION

To accomplish the object, there is provided a flotage trapping device using electrostatic field which comprises a body including a power source portion and a boosting portion for boosting, fed from said power source portion, and a collector portion including a collector to which the plus and/or minus high voltage obtained from said boosting portion is applied, said collector portion being formed as a collector cassette by unitizing said collector portion in the form of cassette, a fixing mechanism being provided between said body and said collector cassette for connecting and disconnecting said body and said collector cassette through one-touch operation, electric connecters for high voltage being provided between said body and said collector cassette for electrically connecting and disconnecting said body and said collector cassette through one-touch operation, whereby said collector cassette is detachably mounted on said body.

There is also provided a flotage trapping device using electrostatic field which comprises a body including a power source portion and a boosting portion for boosting, fed from said power source portion, and a collector portion including a collector to which the plus and/or minus high voltage obtained from said boosting portion is applied, said collector portion being formed as a collector cassette by electric conductor(s) comprising one plus and/or minus electric conductor juxtaposed in parallel by fold-back.

There is also provided a flotage trapping device using electrostatic field which comprises a body including a power source portion and a boosting portion for boosting, fed from said power source portion, and a collector portion including a collector to which the plus and/or minus high voltage obtained from said boosting portion is applied, said collector portion being formed as a collector cassette by electric conductor(s) or conductive flat plate comprising one plus and/or minus electric conductor juxtaposed in parallel by fold-back in which the high voltage transferred from the high voltage generating unit is applied to one end of the electric conductor or conductive flat plate of the collector and the high voltage is received at the other end of the electric conductor or conductive flat plate of the collector and the received voltage is compared with preset values, whereby errors or malfunctions such as breaking of collector, short circuit to the earth, leakage, non-connection of collector or loose connection between the body and the collector can be detected and thus the power source is controlled.

There is also provided a flotage trapping device using electrostatic field which comprises a body including a power source portion and a boosting portion for boosting, fed from said power source portion, and a collector portion including a collector to which the plus and/or minus high voltage obtained from said boosting portion is applied, in which in case that a plurality of flotage trapping devices are installed to enlarge trapping area of flotage, the electric power is supplied to the first master flotage trapping device and supplied to the other slave flotage trapping devices at their power source unit through parallel circuit connection of power supplying wiring therebetween whereby said plurality of flotage trapping devices become operative.

There is also provided a flotage trapping device using electrostatic field which comprises a body including a power source portion and a boosting portion for boosting, fed from said power source portion, and a collector portion including a collector to which the plus and/or minus high voltage obtained from said boosting portion is applied, in which abnormal state detection unit of the main device can detect the abnormal state of every flotage trapping device by communicating each other through signal line when a plurality of flotage trapping devices are installed to enlarge trapping area of flotage.

Other objects, features, and advantages of the present invention will be explained in the following detailed description of the invention having reference to the appended drawings:

BRIEF DESCRIPTION OF DRAWINGS

FIG. 1 shows a first embodiment of a flotage trapping device using electrostatic field according to the present invention, FIG. 2 shows a second embodiment of a flotage trapping device using electrostatic field according to the present invention, FIG. 3 shows a third embodiment of a flotage trapping device using electrostatic field according to the present invention.

DETAILED DESCRIPTION OF THE INVENTION

First Embodiment

Figure 1A:
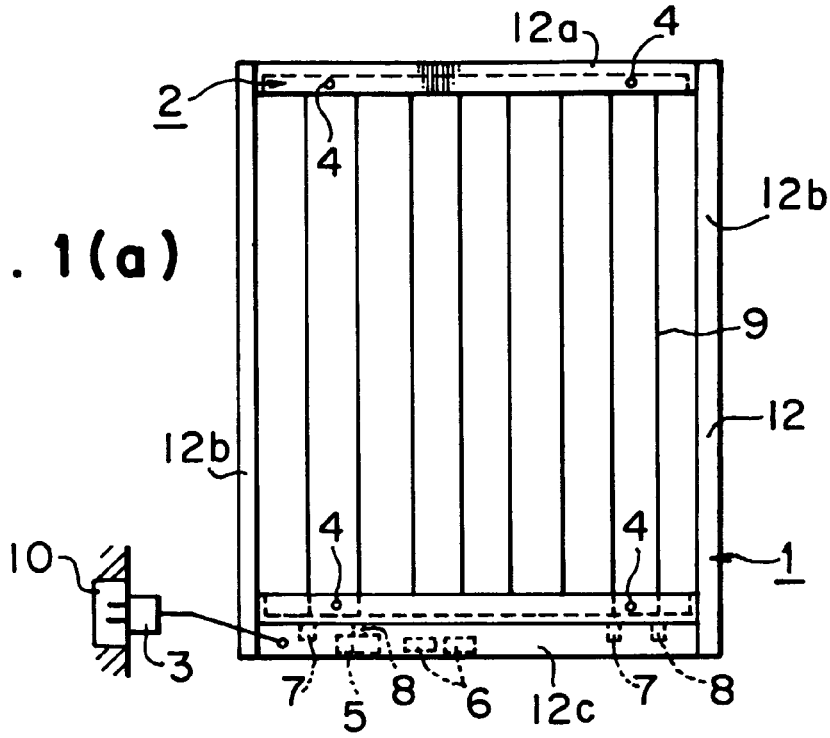
FIG. 1*a* shows the state that the body of flotage trapping device and a collector cassette are assembled.
Figure 1B:
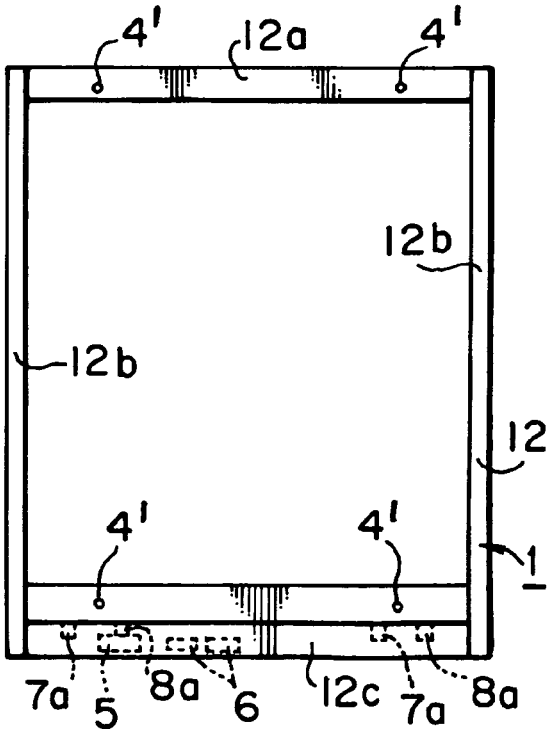
FIG. 1*b* shows the body of flotage trapping device.
Figure 1C:
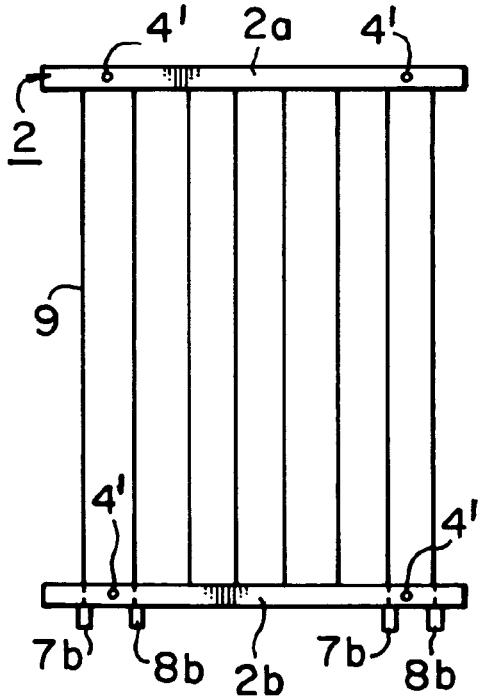
FIG. 1*c* shows the collector cassette.

FIG. 1 shows a first embodiment of a flotage trapping device using electrostatic field according to the present invention, FIG. 1*a* shows the state that the body of flotage trapping device and a collector cassette are assembled, FIG. 1*b* shows the body of flotage trapping device, and FIG. 1*c* shows the collector cassette.

As shown in FIGS. 1*a*-1*c*, a body 1 has a rectangular frame 12, that is, an upper frame portion 12*a*, side frame portions 12*b* on both sides, and a bottom frame portion 12*c*. The upper frame portion 12*a* is formed with pin holes 4' in which fixing pins 4 are inserted to fix a collector cassette 2 to the body 1. The bottom frame portion 12*c* is formed with pin holes 4' in which fixing pins 4 are inserted to fix a collector cassette 2 to the body 1, and is provided with connecters 7*a* and 8*a* of a plus high voltage connecter 7 and a minus high voltage connecter 8 on the body side. Furthermore, the bottom frame portion 12*c* is provided with a power source unit 5 for generating a high voltage and a booster unit 6. The power source unit 5 is fed through an AC adapter 3 from an outlet 10. Plus high voltage and minus high voltage are generated from the power source unit 5 and the booster unit 6 to be fed to the connecters 7*a* and 8*a* or either one of plus high voltage and minus high voltage is fed to either one of the connecters 7*a* and 8*a*. For example one to ten kV is used as high voltage.

The collector cassette 2 has an upper portion 2*a* and a bottom portion 2*b*, which are connected to each other by a collector or trapping member 9 for trapping or capturing flotage. The collector 9 comprises a plurality of flexible electric conductors, that is, electric wires or flat electric conductors. The electric conductors are juxtaposed so that plus and minus high voltages are alternately applied to the electric conductors, or plus high voltage is applied to one group of the electric conductors and minus high voltage is applied to the other group of the electric conductors although high voltage of both polarity don't necessarily apply to the electric conductors at the same time. The upper portion 2*a* is formed with pin holes 4' in which fixing pins 4 are inserted to fix the collector cassette 2 to the body 1. The bottom portion 2*b* is formed with pin holes 4' in which fixing pins 4 are inserted to fix the collector cassette 2 to the body 1 and is provided with connecters 7*b* and 8*b* which are respectively connected to the plus high voltage connecter 7*a* and the minus high voltage connecter 8*a* on the body side.

In assembling the body 1 and the collector cassette 2, to start with, the connecters 7*a* and 8*a* of the body 1 are connected to the connecters 7*b* and 8*b* of the collector cassette 2. Thereafter, in case that the connecters 7*a* and 8*a* are sockets and the connecters 7*b* and 8*b* are plugs, the plugs are inserted into the sockets. Then the fixing pins 4 are inserted into the pin holes 4' of the body and the pin holes 4' of the collector cassette 2 at a one time. This is an easy assembling operation. In disassembling the collector cassette 2 from the body 1, the fixing pins 4 are taken out of the pin holes 4' of both body 1 and collector cassette 2 and then the connecters 7*b* and 8*b* of the collector cassette 2 are taken out of the connecters 7*a* and 8*a* of the body 1. This is an easy disassembling operation.

The above-mentioned construction enables the body 1 and the collector cassette 2 to be assembled and disassembled merely by insertion and taking out of the fixing pins 4 and connection and disconnection of the high voltage connecters 7 and 8. Maintenance of collector which should be periodically carried out is eased by the construction.

Second Embodiment

Figure 2A:
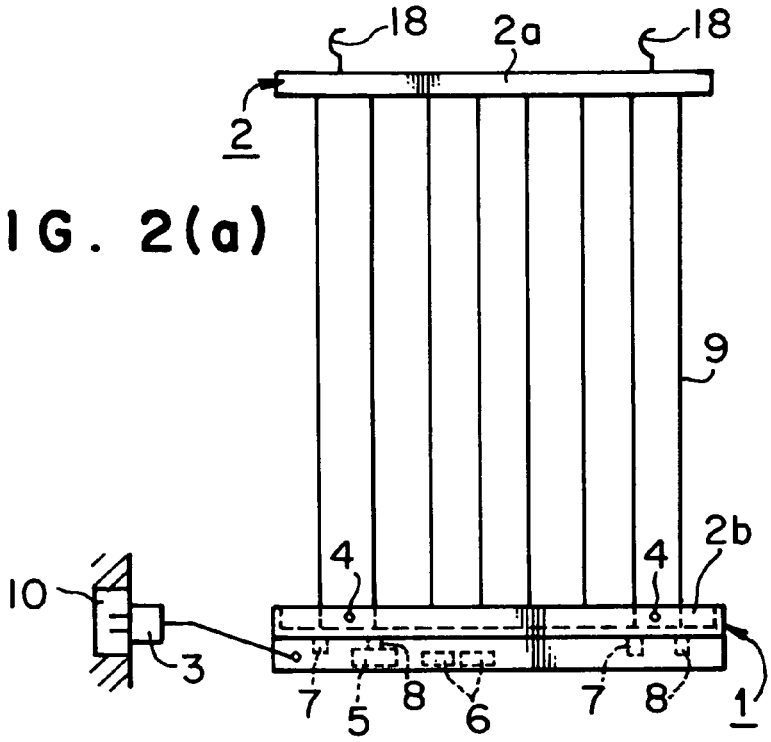
FIG. 2*a* shows the state that the body of flotage trapping device and a collector cassette are assembled.
Figure 2B:
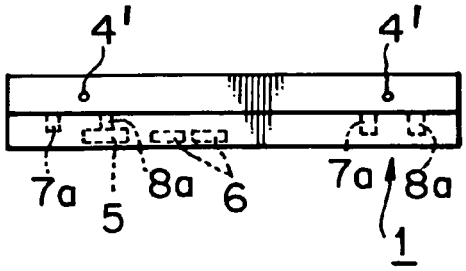
FIG. 2*b* shows the body of flotage trapping device.
Figure 2C:
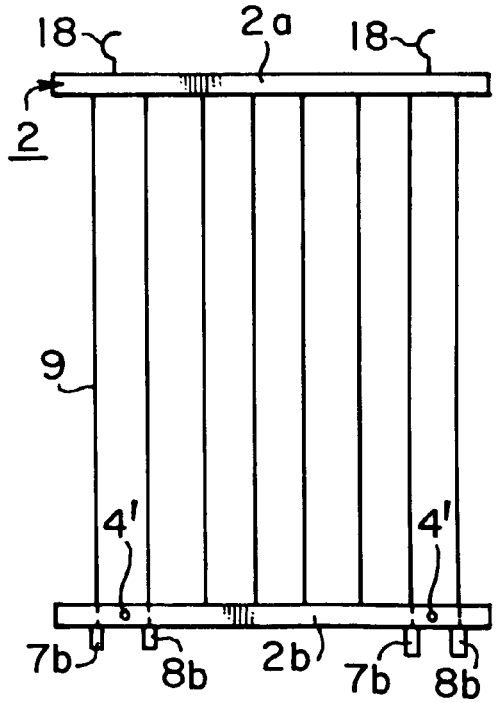
FIG. 2*c* shows the collector cassette.

FIG. 2 shows a second embodiment of a flotage trapping device using electrostatic field according to the present invention, FIG. 2*a* shows the state that the body of flotage trapping device and a collector cassette are assembled, FIG. 2*b* shows the body of flotage trapping device, and FIG. 2*c* shows the collector cassette.

As shown in FIGS. 2*a* to 2*c*, the body 1 is not provided with frame and has only a member corresponding to the bottom frame portion 12*c* in the first embodiment. The collector cassette 2 is not formed with pin holes 4' at its upper portion 2*a* and instead is provided with hooks 18 which are hanged at installation location. The other portions of the collector cassette 2 are similar to those of the collector cassette of the first embodiment.

The body 1 and the collector cassette 2 are assembled by inserting fixing pins 4 in the pin holes 4' of the body 1 and the pin holes 4' of the collector cassette 2 after the connecters 7*a* and 8*a* of the body 1 and the connecters 7*b* and 8*b* of the collector cassette 2. Thereafter, the assembly is hanged at installation location by the hooks 18 provided on the collector cassette 2. This flotage trapping device is of such a construction that the body 1 which is connected to the bottom portion 2*b* of the collector cassette 2 is hanged through the collector 9 from the upper portion 2*a*. Since the collector 9 is under tension due to its own weight, the distance between the upper portion 2*a* and the bottom portion 2*b* are expanded, so that the collector 9 is taut. Therefore, the function of the collector cassette can be achieved.

In the second embodiment, the body 1 and the collector cassette 2 are also mechanically connected by fixing pins 4 after they are assembled, and the body 1 and the collector cassette 2 are electrically connected by the plus and minus high voltage connecters 7 and 8. These connecters can be connected or disconnected by connection and disconnection between the connecters 7*a* and 8*a* of the body 1 and the connecters 7*b* and 8*b* of the collector cassette 2.

The above-mentioned construction enables the body 1 and the collector cassette 2 to be assembled and disassembled merely by insertion and taking out of the fixing pins 4 and connection and disconnection of the high voltage connecters 7 and 8. Maintenance of collector which should be periodically carried out is eased by the construction.

Third Embodiment

Figure 3A:
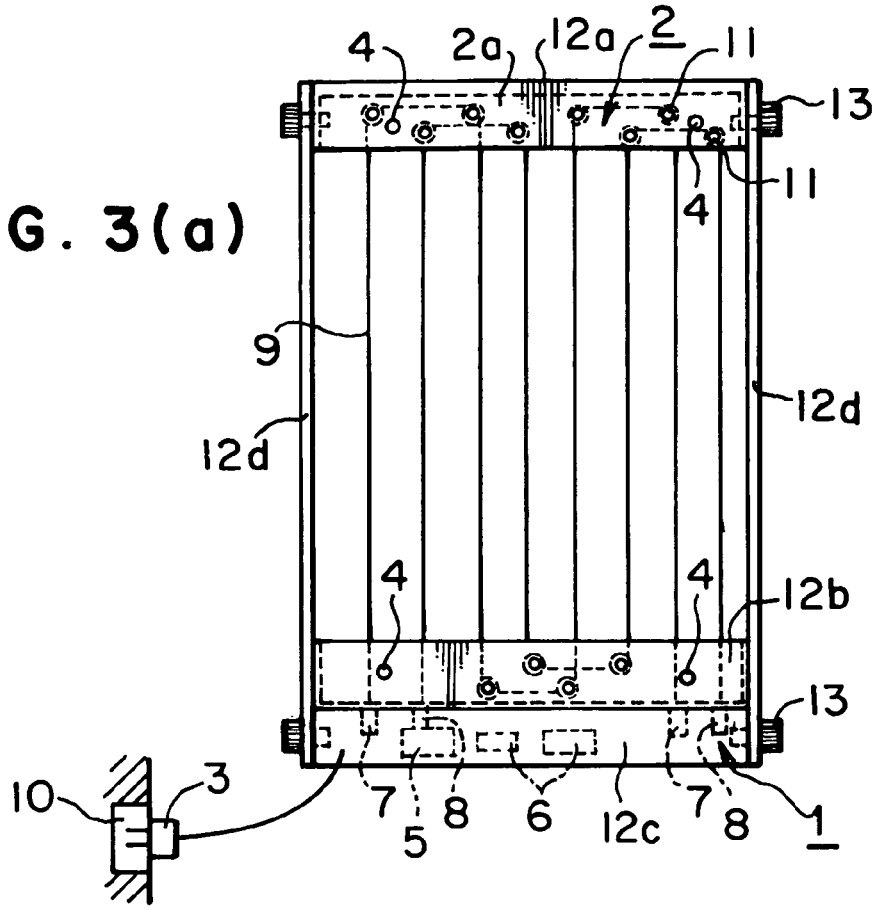
FIG. 3*a* shows the flotage trapping device viewed from its front side.
Figure 3B:
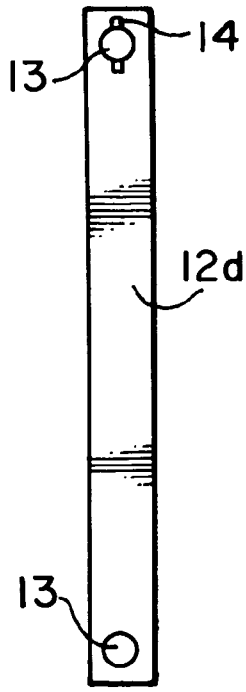
FIG. 3*b* shows the flotage trapping device viewed from its side.

FIG. 3 shows a third embodiment of a flotage trapping device using electrostatic field according to the present invention, FIG. 3*a* shows the flotage trapping device viewed from its front side, and FIG. 3*b* shows the flotage trapping device viewed from its side.

The third embodiment is characterized by the construction in which the plus or minus high voltage collector 9 comprises one electric conductor. Since the plus or minus high voltage collector 9 comprises one electric conductor, juxtaposed electric conductors which would be individually soldered to form the collector cassette 2 are not required, and thus man hour for assembling can be reduced and electric leak at the soldered portions can be eliminated.

As shown in FIG. 3, the electric wire for forming collector 9 is folded back through pulleys 11 which are rotatably attached at the upper portion 2*a*. Both ends of electric wires of collector 9 are connected to the connecters provided at the bottom portion 2*b*. When the distance between the upper portion 2*a* and bottom portion 2*b* opposed to each other is set apart, uniform tension can be given to the electric wire throughout. In the third embodiment, the distance between the upper portion 2*a* and bottom portion 2*b* opposed to each other is changed along vertically adjusting long holes 14 formed at the rigid frames or rigid plates 12*d* while fixing bolts 13 are in loose state. The upper and bottom portions are dragged from the opposite sides to be slightly under tension and then the upper and bottom portions are tightly fixed by the bolts 13. As a result, uniform tension can be given to the electric wire throughout.

4th Embodiment

Figure 4:
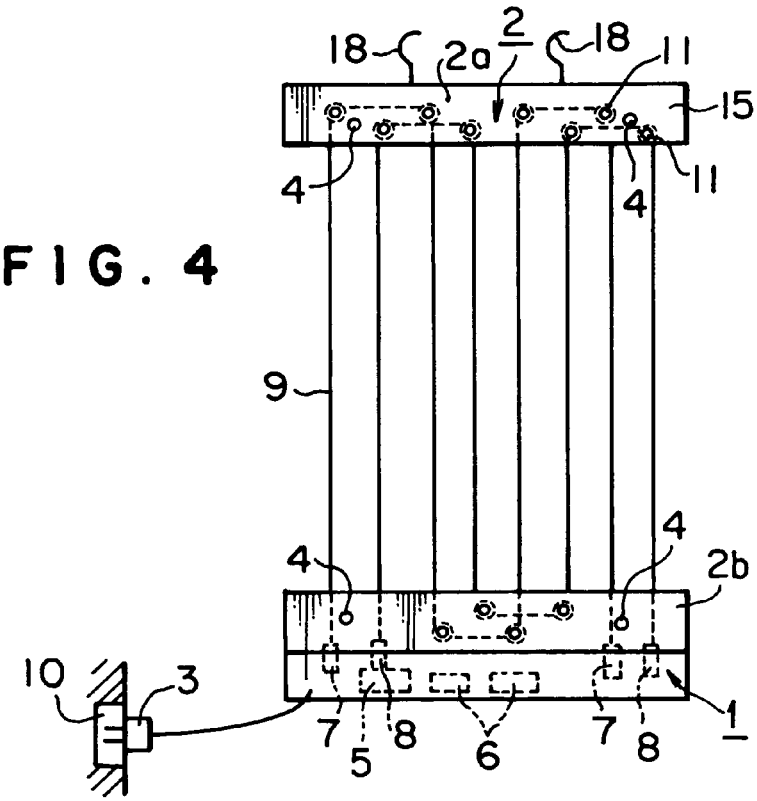
FIG. 4 shows a fourth embodiment of a flotage trapping device using electrostatic field according to the present invention.

FIG. 4 shows a fourth embodiment of a flotage trapping device using electrostatic field according to the present invention. The principle of the 4th embodiment is similar to that of the third embodiment.

The 4th embodiment differs from the third embodiment in that frame is not provided. In the 4th embodiment, when the upper portion 2*a* is set up by the hooks 18, the bottom portion 2*b* and the body 1 connected thereto are hanged through the collector 9 from the upper portion 2*a*. In the state, uniform tension is given to the electric wires of collector 9 throughout due to weights of the bottom portion 2*b* and the body 1.

5th Embodiment

Figure 5:
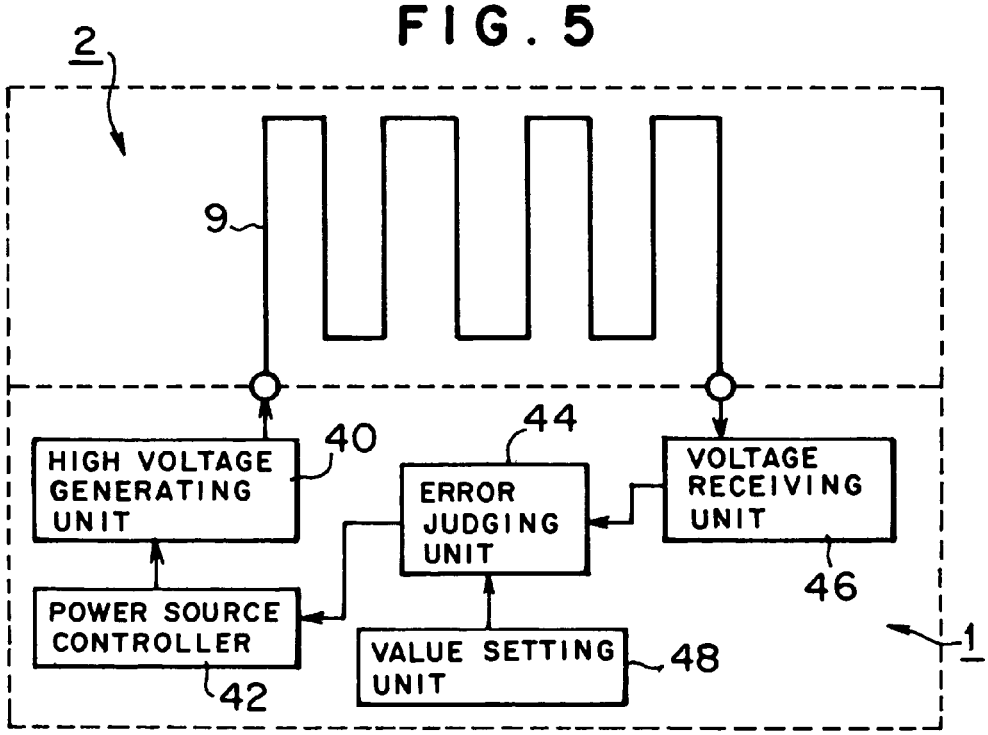
FIG. 5 shows a fifth embodiment of a flotage trapping device using electrostatic field according to the present invention.

FIG. 5 shows a fifth embodiment of a flotage trapping device using electrostatic field according to the present invention. In the embodiment, abnormality, electric error or malfunction detector of flotage trapping device will be explained.

In FIG. 5, although the collector 9 comprises a single electric wire which plus or minus high voltage is applied to, or at least two electric wires, one of which plus high voltage is applied to and the other of which minus high voltage is applied to, for convenience of explanation the single electric wire will be taken as an example. The high voltage generated from a high voltage generating unit 40 provided within the body 1 is applied to one end of collector 9 provided within the collector cassette 2. The voltage output from the other end of the collector 9 is received at a voltage receiving unit 46 provided within the body 1. A value setting unit 48 for setting upper and lower limit values to judge abnormal values such as values generated due to breaking of collector, short circuit to the earth, leakage, non-connection of collector or loose connection between the body and the collector or the like, an error judging unit 44 for judging errors by comparing the output voltage received at the voltage receiving unit 46 with the values set by the value setting unit 48, and a power source controller 42 for controlling the power source, for example, to stop generation of high voltage when the error is detected by the error judging unit 44 are provided within the body 1. By the construction, errors or malfunctions such as breaking of collector, short circuit to the earth, leakage, non-connection of collector or loose connection between the body and the collector can be detected and thus the power source can be controlled.

6th Embodiment

Figure 6:
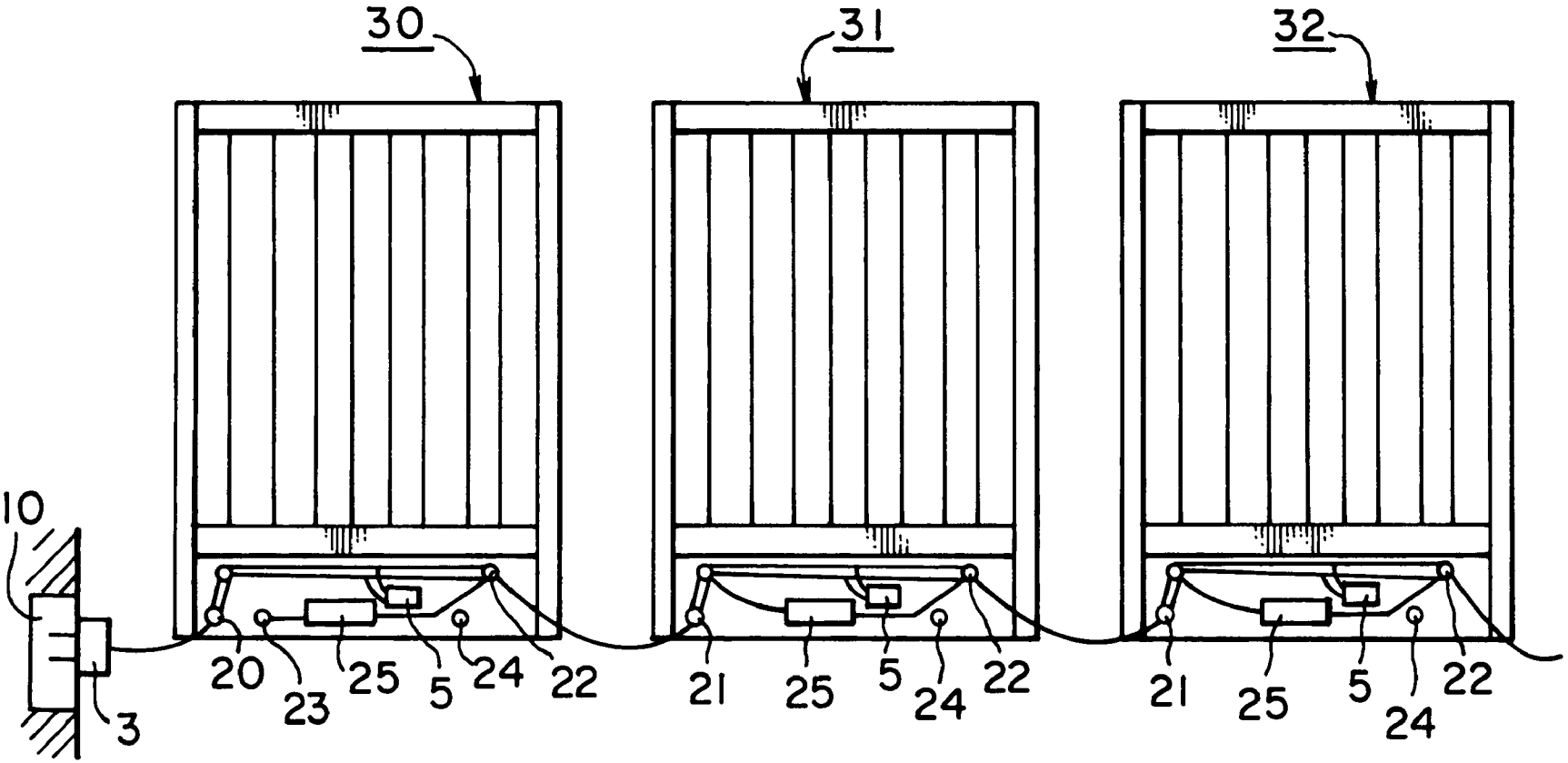
FIG. 6 shows a sixth embodiment of a flotage trapping device using electrostatic field according to the present invention.

FIG. 6 shows a sixth embodiment of a flotage trapping device using electrostatic field according to the present invention. In the sixth embodiment, a plurality of flotage trapping devices is installed to trap or capture flotage in widespread area.

The power supplying device such as AC Adapter are usually required for the flotage trapping devices in numbers. However, in the embodiment of flotage trapping devices, the power source unit 5 within the body 1 is fed from the power supplying circuit connected to the supplied power input terminal 20 of a master device 30 through a parallel circuit and at the same time the power supplying line is connected to a power supplying output/abnormal signal input terminal 22 (is wired) where the power supplying device apply the power through the power supplying line and abnormal state signal is send from another device. Thus, an adjacent slave device 31 becomes operative when the power supplying output/abnormal signal input terminal 22 of the master device 30 is connected to the supplied power input/abnormal signal output terminal 21 of adjacent slave device 31 by being supplied power from main device 30. Within the body 1 of the slave device 31, the power source unit 5 is fed from the supplied power input/abnormal signal output terminal 21 through the parallel circuit at the same time the supplying line is connected to a power supplying output/abnormal signal input terminal 22.

In similar fashion, another adjacent slave device 32 becomes operative by the same principle when the power supplying output/abnormal (error) signal input terminal 22 of the adjacent device 31 is connected to the supplied power (source) input/abnormal signal output terminal 21 of slave device 32. By repeating the construction, a plurality of flotage trapping devices can be driven by one power supplying unit, for example, an AC adapter.

Therefore, even when a plurality of flotage trapping devices are installed preparation of one outlet is sufficient and preparation of one power supplying device, for example, an AC adapter is sufficient.

Now the detection of abnormality, error or malfunction of each device will be explained. The abnormal state of the device is indicated by an LED 24 provided on each device while error occurs on each device at the same time an abnormal signal input and output controller 25 provided on each device detect the error. When the error signal is detected on each device, the abnormal signal input and output controller 25 put out an abnormal signal to the supplied power input/abnormal signal output terminal 21, and then the abnormal signal is put in the power supplying (source) output/abnormal signal input terminal 22 of the adjacent device through the wiring between the devices. At the adjacent device, inputted abnormal signal is put out to the power supplying input/abnormal signal output terminal 21 through its abnormal signal input and output controller 25.

In similar fashion, the abnormal signal is transferred to the upstream device in sequence, and finally is put in the abnormal signal input and output controller 25 of the master device 30. When the abnormal signal is put in the master device 30 from the slave device 31, the central monitoring abnormal LED 23 installed in the master device 30 turns on by the signal from the abnormal signal input and output controller 25. As a result, when the abnormal state occurs at any one of slave devices 31, 32 or the like connected to the master device 30, that abnormal state can be monitored at the master device 30. LED 23 can individually indicate the device 30, 31, 32 or the like in the abnormal state.

As shown in FIG. 6, the supplied power input/abnormal signal output terminal 21 and the power supplying output/abnormal signal input terminal 22 are provided in positions adjacent to opposite sides of each device. This enables the length of wiring between devices to be shortened. Even if a plurality of flotage trapping devices are installed, very short outside wiring is merely required, and thus a very simple wiring construction in appearance can be obtained. Furthermore, the trouble that a person would be caught by the wiring can be prevented.

In the embodiments 1 to 6, by installing an ion generating device, not shown, adjacent to the flotage trapping device, the flotage is forcibly charged and the efficiency of trapping flotage by the collector 9 can be enhanced.

It is understood that many modifications and variations may be devised given the above description of the principles of the invention. It is intended that all such modifications and variations be considered as within the spirit and scope of this invention, as it is defined in the following claims.

The invention claimed is:

1. A flotage trapping device using electrostatic field which comprises a collector portion including a plurality of electric conductors to which plus and/or minus high voltage is applied, an upper portion for holding the upper portions of said plurality of electric conductors, a bottom portion for holding the bottom portions of said plurality of electric conductors, a body including a bottom portion provided with a boosting portion for boosting electric power fed from a power source to generate said plus and/or minus high voltage, a fixing mechanism provided between said bottom portion of said body and said bottom portion of said collector portion for connecting and disconnecting said bottom portion of said body and said bottom portion of said collector portion through one-touch operation, and electric connecters provided between said bottom portion of said body and said bottom portion of said collector portion for electrically connecting and disconnecting said bottom portion of said body and said bottom portion of said collector portion through one-touch operation, whereby said collector portion is detachably mounted on said body.

2. A flotage trapping device using electrostatic field according to claim 1 in which said collector portion further includes side portions connected to said upper portion and said bottom portion, said body further includes an upper portion, and side portions connected to said upper portion and said bottom portion to form a body frame together with said bottom portion whereby said collector is detachably mounted on said body frame.

3. A flotage trapping device using electrostatic field according to claim 1 in which said upper portion of said collector portion is provided with hooks for hanging said collector portion.

4. A flotage trapping device using electrostatic field according to claim 1 in which said electric conductors are juxtaposed in parallel by fold-back between.

5. A flotage trapping device using electrostatic field according to claim 4 in which said electric conductors are folded back in sequence between said upper portion and said bottom portion of said collector portion, upper pulleys are provided at said upper portion of said collector portion, and bottom pulleys are provided at said bottom portion of said collector portion for folding back said electric conductors.

6. A flotage trapping device using electrostatic field according to claim 5 in which the distance between said upper portion and said bottom portion of said collector portion can be changed to give uniform tension to the electric conductors.

7. A flotage trapping device using electrostatic field according to claim 4 in which a receiver is provided for detecting the high voltage received through said electric conductor, and the voltage thus detected is compared with preset values, whereby errors or malfunctions comprising breaking of collector, short circuit to the earth, leakage, non-connection of collector or loose connection between said body and said collector portion can be detected.

8. A flotage trapping system comprising a plurality of flotage trapping device using electrostatic field according to claim 7 in which a plurality of flotage trapping devices are installed to enlarge trapping area of flotage, and the electric power is supplied to a first master flotage trapping device and supplied to slave flotage trapping devices at their power source unit through parallel circuit connection of power supplying wiring therebetween whereby said plurality of flotage trapping devices become operative.

9. A flotage trapping device using electrostatic field according to claim 8 in which a signal line for indicating the state of each slave device is added to said power the supplying wiring as parallel circuit, and said master device centrally monitors state of its own device and slave devices by the signals obtained from slave devices.

10. A flotage trapping device using electrostatic field according to claim 9 in which a power input terminal and a signal input terminal, and a power output terminal and a signal output terminal are disposed at the both ends of the body, the power input terminal and power output terminal is connected within the body, and the signal input terminal and signal output terminal is connected within the body, so that in case a plurality of flotage trapping devices are installed the power/signal output terminal of each device and the power/signal input terminal of each device are connected by outside wiring whereby each device become operative and one master device centrally monitors its own device and the other devices.

11. A flotage trapping device using electrostatic field according to claim 1 in which an ion generating device is combined with the flotage trapping device.

* * * * *